US006402214B1

(12) United States Patent
Weiner

(10) Patent No.: US 6,402,214 B1
(45) Date of Patent: Jun. 11, 2002

(54) HOLDER FOR CHOPSTICK PAIR

(76) Inventor: David A. Weiner, 7709 Chapel Rd., Elkins Park, PA (US) 19027

( * ) Notice: Subject to any disclaimer, the term of this patent is extended or adjusted under 35 U.S.C. 154(b) by 0 days.

(21) Appl. No.: 09/659,773

(22) Filed: Sep. 11, 2000

(51) Int. Cl.[7] ..... A47G 21/10; A47J 43/28
(52) U.S. Cl. ..... 294/99.2
(58) Field of Search ..... 294/1.1, 7, 8.5, 294/11, 33, 99.2; 24/462, 501, 530; 30/142, 150, 322, 324; 239/33; D7/642–645, 686

(56) References Cited

U.S. PATENT DOCUMENTS

| | | | | | |
|---|---|---|---|---|---|
| 2,094,268 | A | * | 9/1937 | Friedman | 239/33 |
| 3,239,262 | A | * | 3/1966 | Rines et al. | 394/99.2 |
| 3,346,187 | A | * | 10/1967 | Mueller | 239/33 |
| 3,409,224 | A | * | 11/1968 | Harp et al. | 239/33 |
| 3,637,248 | A | * | 1/1972 | Arita | 294/99.2 |
| D233,398 | S | * | 10/1974 | Lee | 294/99.2 X |
| 5,486,029 | A | * | 1/1996 | Kobayashi | 294/99.2 |
| 5,791,053 | A | * | 8/1998 | Koong | 294/99.2 X |

FOREIGN PATENT DOCUMENTS

| | | | | |
|---|---|---|---|---|
| DE | 117005 | * | 3/1930 | 294/99.2 |
| FR | 811925 | * | 4/1937 | 294/99.2 |
| GB | 9580 | * | 6/1909 | 294/99.2 |

* cited by examiner

*Primary Examiner*—Johnny D. Cherry
(74) *Attorney, Agent, or Firm*—Ostrolenk, Faber, Gerb & Soffen LLP

(57) ABSTRACT

An appliance for holding chopsticks comprising a paper or plastic sipping straw-like tube with a flexible center formed by a bellows or a thinned web section. Chopsticks are inserted into the opposite ends of the tube and are held therein and their free ends can be controllably brought together by bending the tube at its center.

2 Claims, 1 Drawing Sheet

HOLDER FOR CHOPSTICK PAIR

FIELD OF THE INVENTION

The present invention relates to chopstick eating appliances and, more specifically, to a novel holder for chopsticks which permits their easy usage.

BACKGROUND OF THE INVENTION

Chopstick eating appliances are well known wherein a user grips both of a pair of identical elongated sticks and manipulates them so that their free ends can grip food morsels to move food from a dish or the like to the users mouth, or to any other location. It is known that persons unfamiliar with the use of chopsticks, particularly children, have great difficulty with their use. Even those familiar with the use of chopsticks may be come less adept in their use, due to illness, injury or advanced age.

Many appliances are known to assist in the learning to use, and use of chopsticks by adhering ends of each of a pair of sticks to a central pivot support so that their free ends can more easily be manipulated. These devices have used mechanical parts and springs; or employ expansion loops of complexly shaped resilient materials, which may or may not be reused.

It would be very desirable to provide a support for chopsticks which is easily used, and available without new production or development cost and which is free of dirt or other contamination and is so inexpensive as to be disposable.

BRIEF SUMMARY OF THE INVENTION

In accordance a first embodiment of the invention, the well-known flexible, bellows type of plastic or paper sipping straw is provided with two equally long tubular segments extending from a central flexible bellows section. The straw is easily pre-sterilized and can be made on existing conventional commercial straw manufacturing equipment, but is trimmed to have approximately equal lengths on opposite sides of the flexible bellows. It can be packed with chopsticks, such as conventional wooden chopsticks dispensed in restaurants, or can be handed out separately to children and others needing help in the manipulation of the chopsticks.

In another embodiment, a standard fully tubular straw of paper or plastic can simply have a central notch, leaving a central web to permit the rotation of the ends of the tube. The central web must be sufficiently strong to provide an internal bias which tends to hold the tube in a straight line.

In use, each one of a pair of chopsticks is inserted into a respective end of the plastic or paper "straw." The diameter of the ends of the chopsticks (or their cross-sections) is preferably, but not necessarily sized to frictionally grip the straw interior. The intermediate bellows of the straw (or the notched web) then permits the chopsticks to rotate 180°, bringing their free ends together, but providing a slight force biasing the free ends apart and back toward their coaxial alignment.

Any desired plastic or paper material can be used, and any other desired material can be used for the appliance. The tubular extensions from the center may also have one or more parallel slits to allow the tubes to expand and thus better frictionally grip chopsticks of varying size and cross-sections.

Other features and advantages of the present invention will become apparent from the following description of the invention which refers to the accompanying drawings.

DETAILED DESCRIPTION OF EMBODIMENTS OF THE INVENTION

Figure 1:
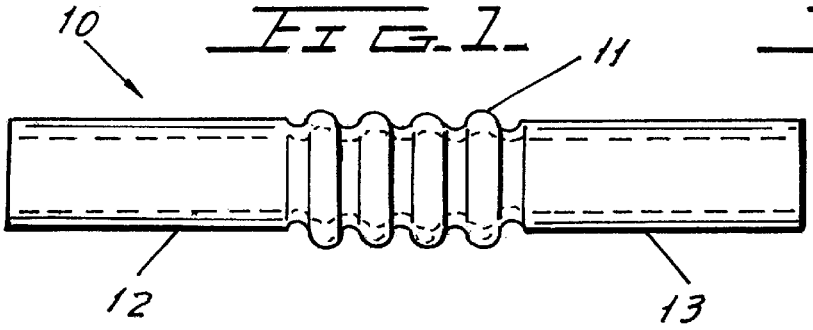
FIG. 1 is a plan view of the novel bellows straw of the invention.
Figure 2:
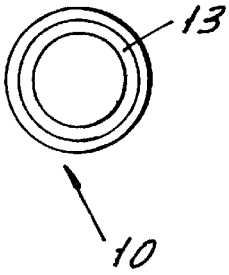
FIG. 2 is an end view of FIG. 1.

Referring first to FIGS. 1 and 2, there is shown a first embodiment of symmetric hollow tubular appliance 10 which is preferably made of a thin plastic extrusion or of a conventional paper straw tube having a central bellows 11 and equal length and identical tubular extensions 12 and 13 which extend integrally from bellows 11. The structure of appliance 10 is identical to that of the familiar sipping straw having a bellows section to permit the straw to extend deeply into a glass and to then bend at the bellows and at the rim of the glass for easy access by a user. The bellows functions to bend to a given angle and remain at that angle; but when fully bent to more than about 90°, tends to return toward a straighter alignment.

Such sipping straws, however, always have unequal lengths from the opposite ends of the bellows. The appliance of the present invention differs from such straws in having approximately equal length tubular sections extending from the bellows. This requires an insignificant change in the trim-to-length process for manufacturing sipping straws to make the appliance of the invention. Further, the appliance of the invention will have short length regions 12 and 13, which may each be about 2 inches long with the standard bellows 11 being about 0.75 inches long. The tube 10 may have any internal diameter, for example, 0.25 inches.

Figure 3:
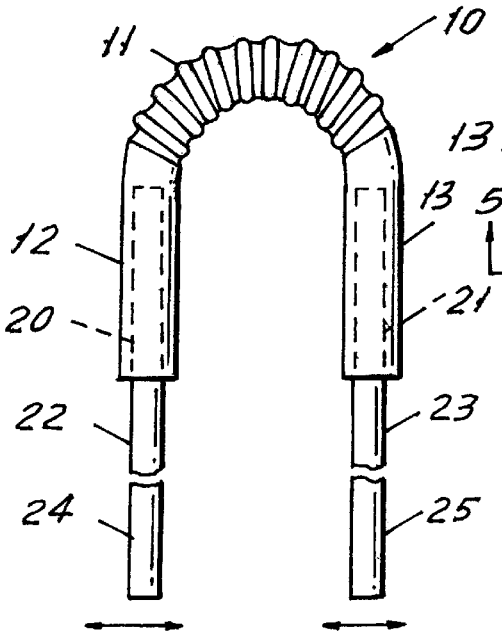
FIG. 3 is a plan view of a pair of chopsticks supported in the appliance of FIG. 1 and then rotated to bring the free ends of the sticks adjacent one another.

In use, and as shown in FIG. 3, the ends 20 and 21 of chopsticks 22 and 23 are inserted into tubular ends 12 and 13 of appliance 10 and are preferably frictionally gripped therein. The bellows can then be bent as shown in FIG. 3 to enable the free ends 24 and 25 to be brought toward one another to grip food or the like. The bellows 10, when fully bent, will act like a bias spring tending to force ends 24 and 25 apart, and the user will press ends 24 and 25 toward one another against the bias during use.

Figure 4:
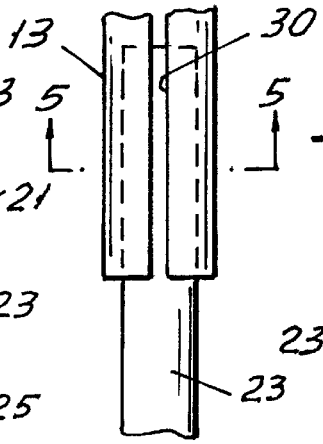
FIG. 4 shows the use of a slit in the tubular stick-receiving part of the appliance to assist in frictionally receiving chopsticks of varying size and cross-sections.
Figure 5:
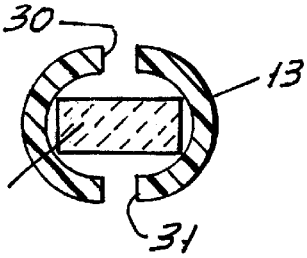
FIG. 5 is a cross-section of FIG. 4 taken across section line 5—5 in FIG. 4.

FIGS. 4 and 5 show slits 30 and 31 in tube 13 which permit the tube diameter to expand when chopstick 23 is inserted therein to allow the frictional gripping of the chopstick over a large range of diameters or cross-sections. Any desired number of parallel slits can be used.

The appliance 10 may be dispensed in a removable paper cover (with advertising copy) to insure its cleanliness when dispensed, although the appliance will not contact food carried by the chopsticks. Thus, copy can be printed on the appliance itself. Obviously, the appliance is inexpensive and disposable, in the same manner as a sipping straw.

Figure 6:
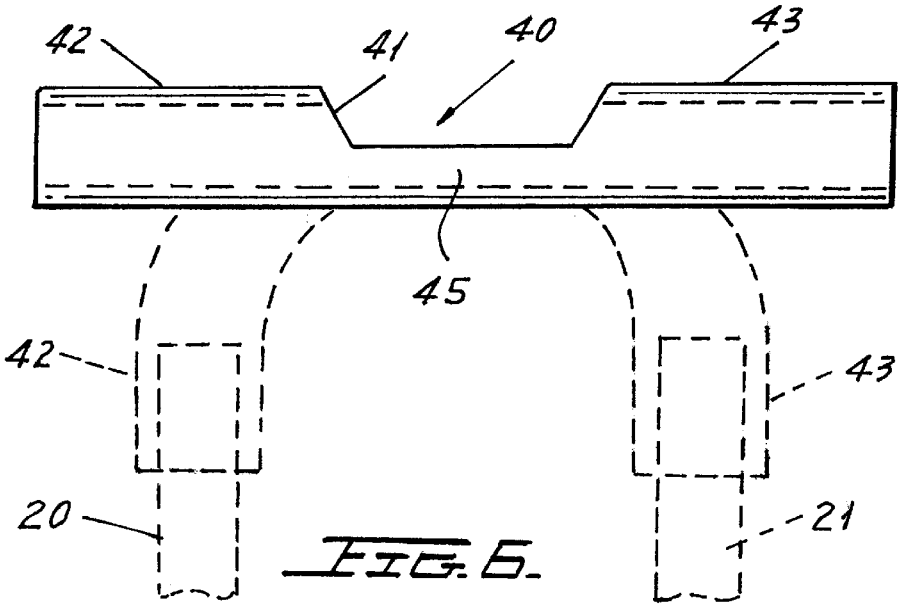
FIG. 6 is a plan view of a second embodiment of the invention.

FIG. 6 shows a second embodiment of the invention and consists of a simple hollow tubular plastic body 40 in which central flexibility is provided by a notch 41 between end sections 42 and 43. The body 40 may have a full length of about 4 to 5 inches, an internal diameter of about 0.25 inches and the central notch 40 may be V-shaped, with any desired length web 45. End sections 42 and 43 receive chopsticks in the same manner as described in FIGS. 3, 4 and 5, but the weakened bridge portion or web 45 provides an effective spring bias permitting the appliance to deflect to the dotted line portion shown in FIG. 6 when the appliance is used.

While the appliance is described as tubular and hollow, the tube may have any desired cross-section, such as circular, as in FIG. 2, but can also be square, rectangular or triangular as well.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a pair of chopsticks each having an end and a free end, and an appliance for holding the ends of said chopsticks together and for permitting their use to grip food at their free ends with said appliance comprising:

a thin elongated hollow tube having a bellows and substantially identical coaxial end sections extending from opposite ends of said bellows;

each said end section internally receiving and gripping said end of one of said chopsticks;

said bellows being internally biased to hold said end sections in given relative coaxial positions relative to one another;

said bellows permitting the rotation of said end sections to a position at which said free ends of said chopsticks can touch one another.

2. The combination of claim 1, wherein said appliance is made of a material selected from the group consisting of paper and extruded plastic.

* * * * *